United States Patent [19]

Sabloewski et al.

[11] 4,041,764

[45] Aug. 16, 1977

[54] PIPETTE DEVICE

[75] Inventors: Horst Sabloewski; Klaus Schürbrock; Dieter Solter, all of Hamburg, Germany

[73] Assignee: Eppendorf Geratebau Netheler & Hinz GmbH, Hamburg, Germany

[21] Appl. No.: 732,212

[22] Filed: Oct. 14, 1976

[30] Foreign Application Priority Data

Nov. 5, 1975 Germany ..... 2549477

[51] Int. Cl.[2] ..... B01L 3/02

[52] U.S. Cl. ..... 73/425.6

[58] Field of Search ..... 73/425.4 P, 425.6; 23/259, 292

[56] References Cited

U.S. PATENT DOCUMENTS

| | | | |
|---|---|---|---|
| 3,853,012 | 10/1974 | Scorodato | 73/425.6 |
| 3,918,308 | 11/1975 | Reed | 73/425.6 |

*Primary Examiner*—S. Clement Swisher

*Attorney, Agent, or Firm*—Toren, McGeady and Stanger

[57] ABSTRACT

A pipette device having an elongate casing with a handle portion at its upper end and an actuating button slidably mounted in the casing and projecting outwardly from the casing at the upper surface of the handle portion. The actuating button is coupled to a piston that is slidably movable within a cylinder disposed within the casing. The lower end of the casing mounts a conical adapter member for receiving replaceable pipette tip members. The actuating button is urged upwardly so that it projects from the upper end of the casing by spring means. A detent means within the casing allows to depress the actuating button into the casing against the spring means by a first distance corresponding to the displacement of the pipetting volume. The detent means may be released by exerting a momentarily increased downward pressure onto the actuating button so that upon release of the detent means the actuating button may be despressed further into the casing by a second distance against the spring means to blow out residual fluid and/or to eject a pipette tip member mounted on the adapter. The actuating button may also be adapted to be rotated with respect to the casing to define various different pipetting volumes by the engagement of corresponding stops with an abutment within the casing. The detent means may consist of magnetic or mechanical engagement members.

11 Claims, 12 Drawing Figures

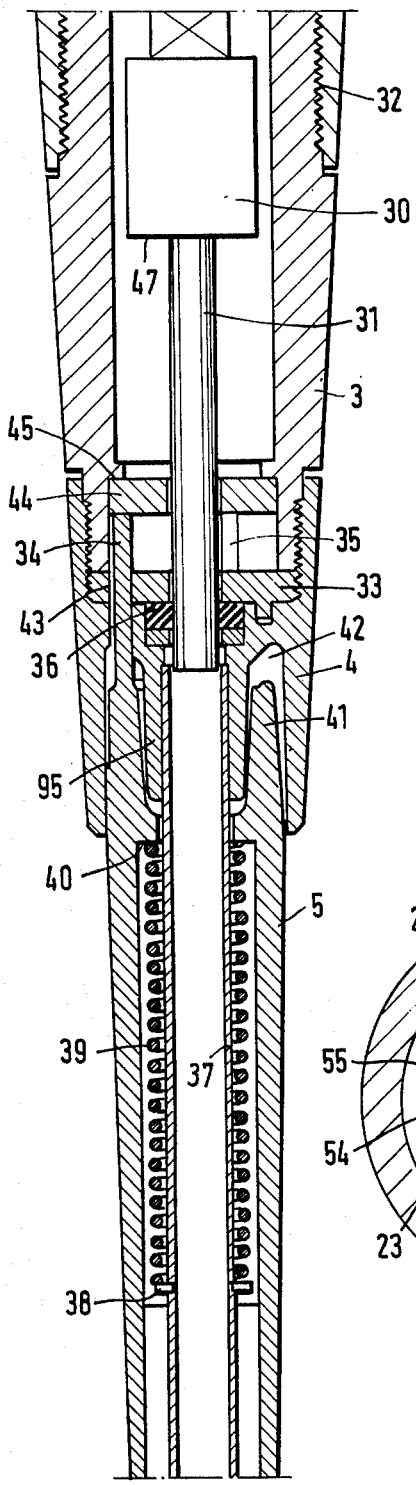
Fig.4
Fig.6
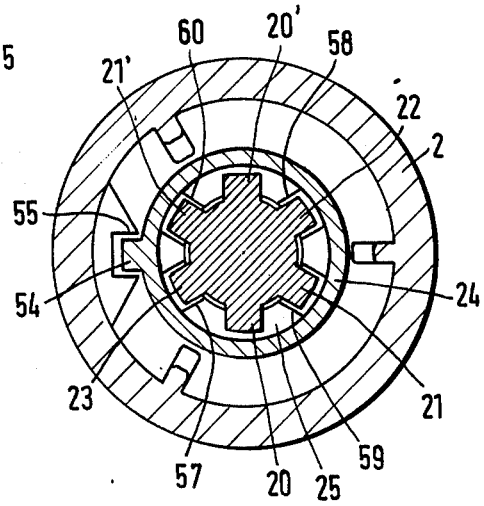

PIPETTE DEVICE

The present invention relates to a pipette device including a casing, an actuating member projecting from an upper end of the casing and adapted to be depressed into the casing against biasing spring means, the actuating member being connected to a piston-cylinder assembly within the casing, the piston adapted to displace an air volume and being connected to an aperture of a connector extension such as an adapter cone for receiving slip-on pipette tip members open at their upper and lower ends, whereby an excess lift movement of the actuating member serves to actuate an ejector device, and the piston, a piston rod associated with the piston or the actuating member includes at least one stop defining an abutment means.

There are already known pipette devices having an ejector device in the form of a casing sleeve extending in the longitudinal direction of the connector extension, the casing sleeve enveloping the cylinder and movable in the longitudinal direction of the casing.

It is likewise known to urge a casing sleeve of this type toward the casing by means of an additional spring.

An example of a heretofore known pipette device of this type is shown by the German Laying-Open specification No. 2,319,175. The pipette device shown in this specification includes a piston that is connected to an actuating rod which in turn projects from the casing. The actuating rod is provided with a limiting stop projecting from one side thereof for defining a calibrated piston stroke that corresponds to a selected pipetting volume. The limiting stop is adapted to engage an outer abutment at the rearward face of the casing. A recess is provided in the actuating rod in a position opposite this limiting stop. This recess allows to deflect the piston rod when the latter has been moved inwardly into a position in which it is slightly spaced from the limiting stop in a manner so that the limiting stop may be passed through the guide aperture of the piston rod in the casing whereby the shoulder at the end of the recess acts as a stop.

This stop serves to define a limit for the piston stroke that may be overcome by an additional piston movement for performing a blowing-out operation by which may be blown out part of the air volume that is enclosed between a pipetting fluid and the piston. An advantageous embodiment of the present invention also allows for this function. The handling of the heretofore known pipette device, however, is rather complicated because the actuating button at the rear end of the projecting piston rod must be moved laterally in the direction of the recess in order to pass the limiting stop through the casing aperture. This operation requires particular skill. Furthermore, there are encountered problems with the mounting of the piston rod since either deflecting movements must be accommodated or specific clearances must be provided. The piston rod is separated from the piston proper and cooperates with the piston merely by an engagement surface.

The spring urging the piston or the piston rod into the normal or respectively rest position is mounted on an abutment, and this abutment is not rigidly connected to the piston rod but is merely biased by this piston rod. If for some reason there should be encountered jamming within the interior of the pipette casing, this malfunction quite often cannot be noticed from the projecting part of the piston rod, with the result that the operation of the pipette device may be incorrect. In this prior art device is provided a casing sleeve urged by a so-called additional spring toward the casing which concurrently provides a handle means. In the heretofore known embodiment, this casing sleeve is in no way connected to an actuator member for the cylinder or the piston rod. This casing sleeve is guided by means of a so-called ejector sleeve that is disposed intermediate the casing end facing the adapter cone and the remote end of the casing sleeve. This ejector sleeve may be provided about its circumference with e.g., edge portions of an ondulated or sinosoidal cross-section cooperating with mating profiled edge portions on a cylindrical extension at the facing casing end. By rotating the ejector sleeve and thereby mutually dislocating these profiled edge portions the casing sleeve may be moved toward the adapter cone for pressing by its end against the edge of the pipette tip member to eject the same. This operation is likewise rather complicated because the ejector sleeve disposed in the extension of the handle defining casing may not be rotated by the hand by which the casing is being held. The operation requires the use of at least two hands.

The heretofore known pipette device of the German Laying-Open specification No. 2,248,573 exhibits similar drawbacks. Although in this pipette device the so-called casing sleeve need not be rotated, the casing sleeve must be urged away from a handle abutment at the casing proper against the bias of a so-called further spring. For carrying out this operation, there are likewise needed two hands, or the device must be gripped by one hand in two subsequently different positions. In this embodiment an actuating button projects from the rear casing end, and this actuating button is directly connected to the piston within the casing. This embodiment does not provide an additional piston stroke beyond the calibrating pipetting volume, for blowing out part of the air and thereby residual fluid.

When releasing the actuating button in the conventional manner before the pipette tip member has been ejected, there will be generated a suction effect through the pipette tip member, before the latter has been ejected, so that there arises the risk of contamination.

In the pipette device of the German Pat. No. 1,090,449 there is provided an excess lift movement against the force of a special spring for carrying out the blow-out operation. Designs of this type have the inherent drawback that overshooting the force threshold by a small distance will not be noted by the user, and this may be a cause of errors. To reduce this risk, the force threshold is made relatively high. The excess lift movement against a special spring requires, therefore, a distinctly increased actuating pressure force which leads to rapid fatigue by the user who will mostly be female laboratory assistants. When exerting a pressure force by the thumb of a hand, all of the other muscles in the arm are likewise stressed by reflectory mechanisms. This inadvertent stressing leads necessarily to stiffening effects on the wrist and rapid fatigue of the forearm. Furthermore, the reflectory effects result in an especially tight grip on the pipette body, and this in turn contributes to an undesired clenching while performing this work. Similar fatigue effects or respectively delays caused thereby will be encountered when two hands are required, or the device must be gripped in different positions by one and the same hand.

The heretofore known pipette devices as described above include pin type adapter cones onto which may be "plugged" or slipped the conical pipette tip member. The pipette device of the present invention retains this feature.

It is an object of the present invention to provide an improved pipette device of the general type as stated at the outset of the present specification wherein by one hand and without changing the position of the hand on the device may be carried out different operations, i.e., actuating the piston for performing the stroke corresponding to a calibrated pipetting volume, actuating the piston for blowing out fluid and actuating the piston for moving the casing sleeve to eject a pipette tip member. The force which the one hand holding the device must exert should be reduced to a minimum, and for increasing the safety of operation there should be perceivable indications bringing to the user's notice that certain movements or functions are being achieved.

In accordance with the present invention, this object is achieved by the fact that the above mentioned abutment means includes releasable detent means adapted to be released by a temporarily increased actuating pressure on the actuating member. When releasing the releasable detent means, there is advantageously generated an acoustic noise signalling acoustically to the user or an instructor that an excess lift or stroke movement is being performed. This releasable detent means defines at the end of the stroke corresponding to a calibrated pipetting volume a positive noticeable limitation that may readily be overcome whereby the engagement of the stop with the abutment generates the mentioned acoustic signal.

When employing an ejector device as above described, the pipette device of the present invention with the single actuating member comprises an axially guided actuating button which is non-rotatably movable for carrying out a pipetting operation and for ejecting a pipette tip member. In a simple embodiment with only one spring the casing sleeve serving as an ejector device may be moved by further depressing the actuating button into the casing whereby the return movement may be ensured by mechanical attachment means between the piston or a piston rod and the casing sleeve, such as a lost-motion connection. There may likewise be provided an additional spring to replace the lost-motion connection. An advantageous characteristic is that only the actuating button but no part of the piston rod projects from the casing, in contrast to one of the above described prior art devices.

The releasable detent means preferably defines three distinct movement sections of the actuating button, by employing only a single spring or advantageously two springs, whereby these movement sections correspond to the calibrated pipetting volume, to the blow out movement and to the shifting of the casing sleeve respectively. In accordance with an advantageous embodiment, the releasable detent means distinguishes between two path sections in the path of movement of the actuating button which is biased by spring means, due to the "feeling" or noticeable magnitude of the spring characteristics, and that at the limit of the second path section the movement of the casing sleeve will be opposed by an increased counter pressure exerted by an additional spring.

In accordance with another advantageous embodiment, a member of the releasable detent means is associated with the piston rod and biased by an additional spring, the spring tending to lock the releasable detent means whereby subsequently to the temporarily increased actuating pressure for releasing the releasable detent means an actuating pressure increase that is of a nature similar to the one for the first movement path section is required for blow-out operation.

The first spring that may be compressed during the path of movement of the piston corresponding to a calibrated pipetting volume, and which may be compressed further beyond this movement corresponding to the calibrated pipetting volume by a respective further movement of the piston and whereby within this compression range of the single spring the releasable detent means may be engaged constitutes an embodiment requiring merely a temporarily increased actuating pressure. The spring itself may be of a relatively weak spring characteristics. Therefore the thumb depressing the actuating button of the hand holding the device is virtually under no stress. A short period or temporary increase of actuating pressure for overcoming the releasable detent means does not lead to fatigue of the thumb because the required releasing pressure need only be applied momentarily and the actuating pressure is only slightly increased when further compressing this spring for blow-out operation over the excess stroke range.

As already pointed out above, there may also be provided another additional or second spring, or even a third spring adapted to be compressed by movement of the piston beyond the path of movement corresponding to the calibrated pipetting volume. These springs are active in parallel to the first spring and may consist of relatively weak springs so that the actuating pressure is only slightly increased within the excess stroke range. In accordance with another embodiment there may be provided an additional spring adapted to be compressed by movement of the piston along a short distance in excess of the distance corresponding to a desired pipetting volume. This additional spring may be of a similar or a weaker spring characteristic than the spring at the actuating button. When providing a further spring for urging the casing sleeve toward the casing, this spring may likewise be of a small spring characteristics. In an embodiment that is substantially designed as proposed by the present invention, the force characteristics of the actuating button that constitutes the single actuating member comprises at least two sections of substantially similar gradients when employing only one spring, these two sections being separated by a sharply defined pulse section. When employing three springs the second section extends behind the pulse from a somewhat higher value than the end portion of the first section, and may be of a slightly higher gradient in dependence upon the spring characteristics, whereas the third section extends from behind a vertical step and is of an increased gradient corresponding to this further spring. The steps between the various sections are due to the different spring bias.

This constitutes an important characteristic of the present invention by which the handling of the device is greatly facilitated. The actuating member may be readily operated by the hand holding the device and consists of an actuating button allowing to perform all functions without needing to change the grip on the device and whereby the various functions are distinctly noticeable.

In a particularly preferred embodiment of the present invention the releasable detent means comprises a magnetic assembly of a pair of magnetic members, one magnetic member of the assembly being secured to the casing, and the other of the magnetic members being arranged at the abutment means or defining the same. At least one of the members of this magnetic assembly consists of a magnet whereas the other member is a magnetizable element such as a shunting element. A magnetic assembly is advantageous insofar as the magnetic attractive forces are virtually zero as soon as a predetermined air gap has been overcome so that correspondingly only a momentarily increased actuating force is required and otherwise the movability is virtually unimpeded. Another advantage of the magnetic assembly is that when closing the releasable detent means in the final range of movement the magnetic force becomes again active and thus a safe interconnection is ensured when releasing the actuating button, due to the inherent forces of the releasable detent means. An arrangement of this type of the detent means, i.e., producing its own forces, constitutes a particularly preferred characteristic of the present invention. By this arrangement the additional spring effective in the excess stroke range may be eliminated. When the first stop defined by the magnetic assembly is only slightly overshot, the interruption of the magnetic attractive force will be readily noticed so that any incorrect handling will be noticed at once and can thus be avoided.

In accordance with another suitable embodiment of the present invention the releasable detent means may likewise comprise mechanical detent means for limiting the pipetting volume, the locking force of the detent means being adapted to be overcome by a temporary force increase. The detent means may include a member rigidly mounted in the casing, the member having a groove, and movable resilient detent fingers at the movable abutment means, the detent fingers including curved or bent detent portions adapted to engage the groove, and a conical engagement surface being provided at the stationary member of the spring detent system adjacent the groove and facing in the direction of movement of the movable abutment means. This embodiment represents one of various advantageous embodiments. The preferred embodiment, however, of the present invention consists in the above described magnetic detent means.

According to another suitable modification the actuating button may be rotatably mounted together with the piston rod, and detent means operable in circumferential direction may be provided for adjusting various stops along the piston rod to cooperate with the abutment means.

In a suitable embodiment, a plurality of circumferentially displaced stops are arranged along the piston rod, the stops extending up to different axial heights, and an abutment means at the releasable detent means includes radial recesses corresponding to the arrangement of the stops for passing all but one stop through the plane of the abutment means. There may of course also be provided pairs of diametrically opposed stops and pairs of corresponding diametrically opposed radial recesses.

With this arrangement, the magnetic members of the releasable detent means may advantageously consist of cooperating disc-shaped or respectively annular magnetic elements of alternate polarities in circumferential direction whereby mutual rotational displacements of the members serve to predetermine positions corresponding to a selected pipetting volume. One of the magnetic members may be mounted within the casing so as to be movable in the axial direction thereof but not allowed to perform rotational movements with respect to the casing. The other of the magnetic members may be held in an axially predetermined position and adapted to be rotated together with the actuating button or the piston rod. One of the magnetic members, i.e., the actuating button, the piston rod or the rotatable magnetic member may include detent means for preventing an undesired free rotation. The detent means may consist of a spring adapted to engage an axially corrugated portion on e.g., the piston rod or a radially corrugated portion of the rotary disc-shaped magnetic member.

In addition to the magnetic assembly serving as a releasable detent means there may be provided an additional magnetic assembly that likewise exhibits alternate polarities in circumferential direction, as described above whereby a polarized portion extends substantially radially. The invention thus provides a pipette device having two magnetic assemblies, i.e., a magnetic assembly serving as a releasable detent means for metering the piston movement, and another magnetic assembly for selecting a calibrated pipetting volume. In both embodiments, i.e., in the embodiment having only one magnetic assembly with magnetic members of alternate polarities in circumferential direction, or in the embodiment with two magnetic assemblies one of which includes the alternate polarities for selecting a predetermined pipetting volume, there is preferably provided a gap between the mutually opposed faces of the disc-shaped magnetic members, and in this gap is advantageously disposed at least one thin layer of e.g., a low-friction plastic material or a skidding lacquer, in order to allow for relatively easy adjustability even when keeping the disc-shaped magnetic members in precise mutual alignment.

Mutually facing sides of cooperating disc-shaped magnetic members may be provided with radial profiled sections that may at least partially engage each other. These radial profiled sections may consist of radial teeth for defining well determined adjustment positions. The radial teeth would in this case of course be arranged in a pattern according to the alternate polarities of the disc-shaped magnetic members. The radial profiled sections may include inclined flanks or be of a sinosoidal contour.

According to a still further suitable modification a projecting acute edge tip may be provided at one side of the connector portion or adapter cone respectively adjacent the bore of this portion.

The purpose of an acute edge tip of this type is to cut into bubbles that may have been sucked in, in order to avoid the aspiration of surface layers or impurities into the pipette or to prevent such substances from migrating into the pipette.

In the following, the present invention will be described more in detail with reference to several advantageous embodiments illustrated in the appended drawings. In the drawings:

FIG. 4 is a sectional view of the portion IV of the pipette device shown in FIG. 1;

FIG. 6 is a cross sectional view along the line VI—VI of FIG. 3;

Referring to the drawings, the same reference numerals are being used throughout the various figures for indicating similar parts of the device.

Figures 1, 2:
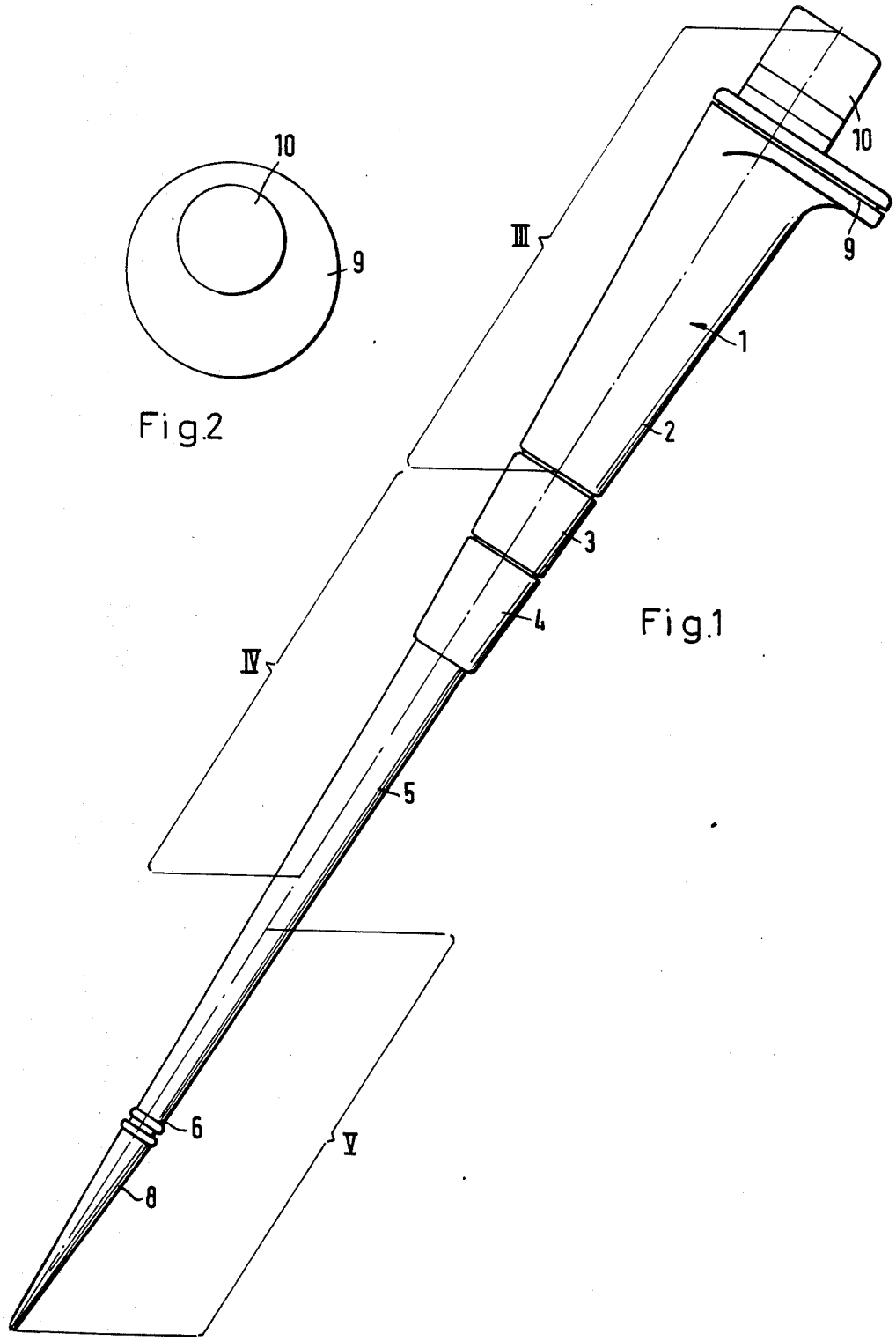
FIG. 1 is a schematical lateral overall elevational view of a pipette device in accordance with a first embodiment of the present invention, this view illustrating the assembly of the various members.
FIG. 2 is a top view of the upper end of the pipette device shown in FIG. 1 and illustrating the actuating button.

The pipette device shown in FIG. 1 includes a casing 1 of a generally conical configuration. The casing 1 may consist of two threadedly interconnected casing portions 2 and 3. An assembly of this type may be suitable for assembling purposes on the one hand, and for providing a modular type of assembly on the other hand by which may be designed pipette devices of various pipetting volumes. Another casing portion 4 of likewise a conical configuration is threadedly connected to the casing portion 3. The casing portion 4 is adapted to receive the upper end of an axially movable casing sleeve 5. The lower edge of the casing sleeve 5 is provided with a peripheral bead 6. This peripheral bead 6 movably encloses a connector or adaptor cone 7 onto which may be engaged a conically tapered pipette tip member 8.

The casing portion 2 is provided at its upper end with a disc-shaped end member 9 extending at one side from the casing. This end member 9 is preferably held between index and middle fingers of the hand holding the device when using the same. An actuating button 10 extends from an aperture at the upper surface of the end member 9. The actuating button 10 is adapted to be depressed into the casing by means of the thumb of the hand holding the device whereby the casing is retained by engagement of the hand with the laterally projecting disc-shaped end member 9.

With reference to FIGS. 3 to 6 will now be described more in detail the preferred embodiment. As may be seen in these drawings, a piston rod 11 rigidly connected to the actuating button 10 is slidably mounted within the interior of the casing portion 2. The actuating button 10 is biased by a weak first spring 12 and is provided at its lower edge with an outwardly projecting flange 13 underlying the inneredge 14 of an opening 15 through which the actuating button 10 extends outwardly from the casing. This flange 13, therefore, delimits the outward movement of the actuating button 10. A member 19 of a releasable detent 18 is secured such as by a screw coupling 17 to a shoulder 16 of the casing portion 2. This member 19 serves to define a casing support for the relatively weak spring 12 tending to urge the actuating button 10 upwardly, i.e., into a position in which this actuating button 10 projects outwardly from the upper surface of the casing portion 2. The piston rod 11 extends through this releasable detent 18 and includes, below the member 19 of the detent, several stops 20, 21, 22 and 23 spaced about the circumference of the piston rod and extending up to various axial heights. These stops may likewise be arranged in pairs, as shown e.g., by stop 22 when compared to stop 23.

In this embodiment the piston rod 11 may be connected to the actuating button 10 so that the two members may be rotated relatively to each other in order to select various pipetting volumes in accordance with the different heights of the stops 20 - 23. It will be understood that a single pipetting volume pipette device will only be provided with one of these stops 20 - 23 or suitably a pair of such stops whereby the stops will be diametrically opposed and extend up to a predetermined height.

In an embodiment allowing to select a predetermined pipetting volume the bottom of the actuating button 10 disposed within the casing portion 2 mounts a mechanical detent 94 that is adapted to lock the actuating button in a selected rotary position. Mechanical detents of this type are already known so that a detailed description thereof is not believed necessary. In this context, however, it is important to note that the stops 20 and 21 may selectively be engaged with an abutment 25 by depressing the actuating button inwardly. The abutment 25 may consist e.g., of an inwardly directed flange at the lower end of a sleeve 24 the upper end of which defines the second member of the releasable detent 18. This sleeve 24 is made of a ferromagnetic material. The first member 19 receives the annular magnetic member 26. The releasable detent thus comprises the integrally connected members 19 and 26 that are rigidly secured to the casing portion 2 on the one hand, and the movable member consisting of the sleeve 24 on the other hand.

The sleeve 24 is being urged upwardly, i.e., into the locking position of the releasable detent 18, by an additional spring 27. When for example the stops 22, 23 engage the abutment 25 and the actuating button 10 is depressed still further downwardly, the members 19, 26 on the one hand and member 24 on the other hand of the releasable detent 18 will be separated, i.e., will be forcibly spaced apart, in overcoming the magnetic attraction, and the sleeve 24 together with the piston rod is moved further downwardly.

The additional spring 27 is disposed about a connecting member 28 that may be of a cylindrical configuration and which is rigidly secured to the piston rod 11 and is arranged in the extension of the piston rod. This connecting member 28 extends through a shoulder 29 in the casing portion 2. The lower end of the additional spring 27 engages this shoulder 29.

Figure 3:
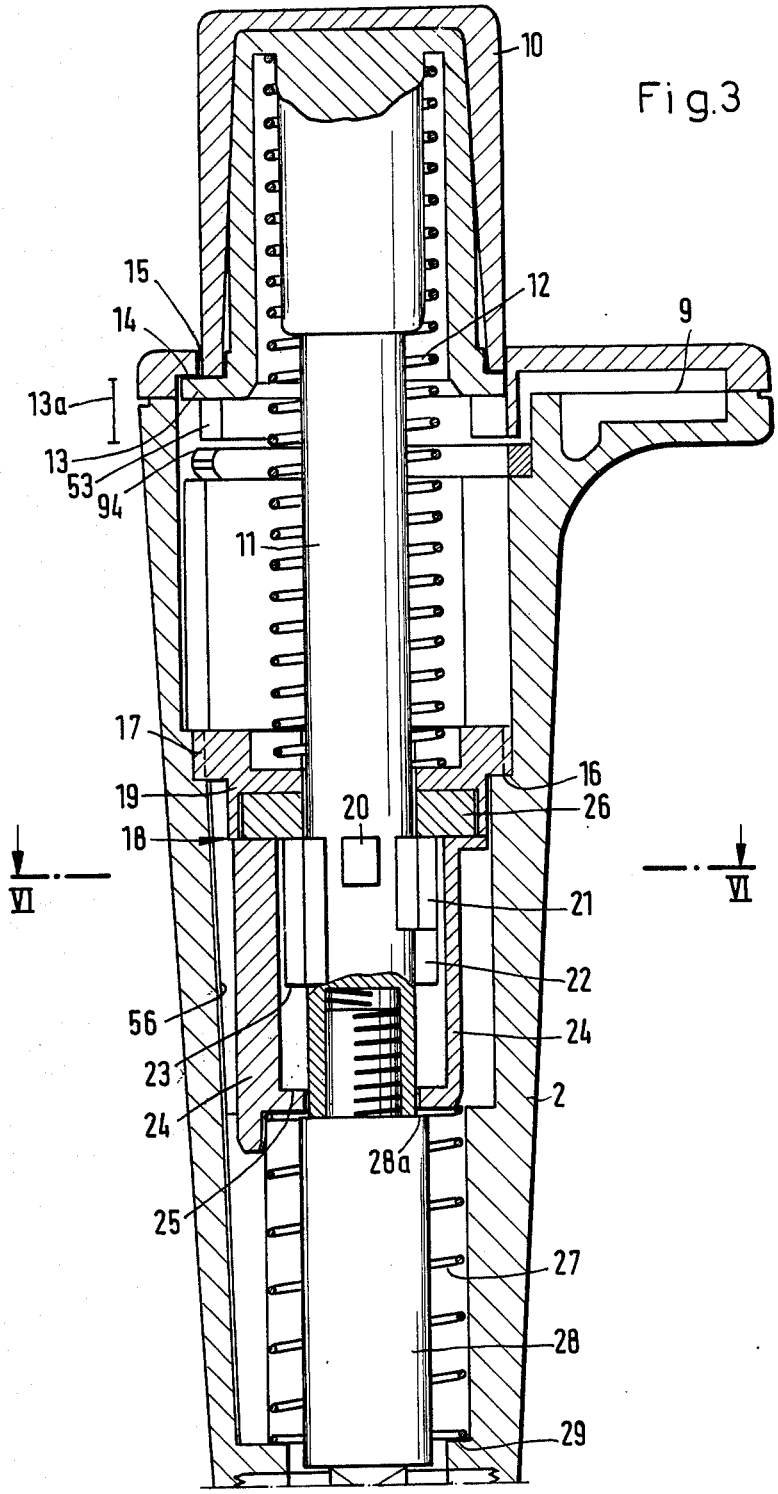
FIG. 3 is a sectional view of the portion III of the pipette device shown in FIG. 1.

As may be seen from FIG. 3, the abutment 25 forms an inwardly directed flange overlying an upwardly facing shoulder 28*a* the horizontal shoulder surface of which is formed by the face portion of a larger diameter than the piston rod of the connecting member 28. With this embodiment, the additional spring 27 may be omitted since upon disengagement of the releasable detent the spring 12 will be further compressed, and after releasing the actuating button this shoulder formed at the upper edge of the connecting member 28 will entrain the sleeve 24 by means of the abutment 25 in an upward direction into a position in which the magnetic forces are sufficient to again interlock the releasable detent 18.

A stop member 18 is ridigly connected to the connecting member 28. The piston 31 is connected to the bottom end of this stop member 30. The stop member 30 is movably mounted within the casing portion 3 that is connected to the casing portion 2 at 32 e.g., by a thread coupling. The casing portion 4 is connected to the casing portion 3 by another joint including a disc 33 having a plurality of circumferentially spaced apertures 43 through which may extend bar-type extensions 34, 35 projecting from the upper edge of the casing sleeve 5.

A cylinder 37 is airtight fitted into an inner extension 95 and below the disc 33 of the casing portion 4. An annular gasket 36 is interposed between the disc 33 and the piston 31. As may be seen in FIG. 5, the connector or adapter cone 7 is attached to the lower end of the cylinder 37 and connected thereto e.g. by a thread connection. The cylinder 37 includes, in a position spaced from the casing portion 4, an external abutment 38 for the so-called additional spring 39. This additional or further spring 39 engages, by its other upper end, an inwardly facing shoulder 40 of the casing sleeve 5. By this arrangement, the casing sleeve 5 is urged, at its upper end 41, into a downwardly open annular recess 42 of the casing portion 4 whereby the bar-type extensions 34, 35 extending through the apertures 43 bias the abutment disc 44 upwardly against a downwardly facing shoulder 45 of the casing portion 3.

When moving the actuating button 10 further inwardly upon the detent 18 so as to likewise compress the spring 27 or only the spring 12, the stop member 30 will engage the disc 44 and entrains the casing sleeve 5 downwardly by means of the bar-type extensions 34, 35, in thereby compressing the spring 39 whereby this movement will be sufficient to eject the pipette tip member 8 by engagement of the bead 6 with the upper edge 46 of the pipette tip member 8.

The movement of the limiting stops is of course selected so that even after the stop 20 corresponding to the largest pipetting volume has engaged the abutment 25 there will still be possible an inward movement of a size sufficient to firstly, upon disengagement of the detent 18, bring the bottom surface 47 of the stop member 30 into engagement with the disc 44 for performing the above described blow-out operation, and subsequently move the disc 44 downwardly until the edges 6 and 46 engage each other and may be moved downwardly for ejecting the pipette tip member 8.

Figure 12:
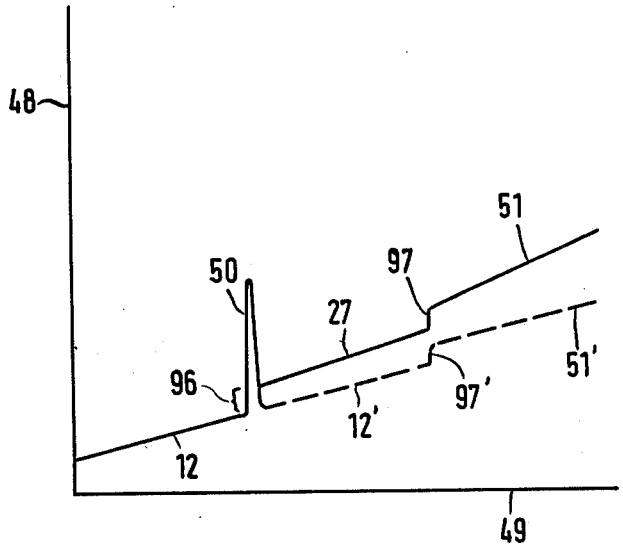
FIG. 12 is a graph illustrating the force characteristic of the actuating force in dependence upon the path of actuating movement of a preferred embodiment of the pipette device of the present invention.

FIG. 12 shows a graph in which the ordinate axis 48 indicates qualitatively an actuating force exerted onto the actuating button 10, and the abscissa axis 49 indicates qualitatively the path of movement of the actuating member or button. The first portion of the illustrated characteristics is only slightly inclined and shows a comparatively small gradient. This first portion corresponds to the movement for discharging a calibrated pipetting volume and is dependent upon the spring characteristic of the first spring 12. When one of the stops 20 to 23 engages the abutment 25, a momentarily increased actuating pressure corresponding to the peak 50 is required in order to disengage the releasable detent 18. For further movement of the actuating button an additional opposing force generated by the additional spring 27 is effective so that this portion of the curve is somewhat more inclined. The step 96 is due to the pretension of the additional spring 27. When the step member 30 engages the abutment disc 44, the additional force of the third spring 39 has to be overcome for ejecting the pipette tip member, in thus resulting in the still more inclined portion 51 of the characteristic following a step 97 which is again due to the pre-tension of the spring 39.

When for example the additional spring 27 is omitted the curve behind the peak 50 would correspond to the dashed portions 97' and 51'.

It goes without saying that the curve portion 27 represents the sum of the spring constants of the springs 12 and 27.

Both springs may be of similar weak spring characteristics because compression of the spring 27 will only be possible after releasing the releasable detent 18 and subsequently the constants of both springs will be jointly active. In this context it would have to be considered that the detent 18 provides its own retaining force that will become zero after releasing the detent.

Figure 5:
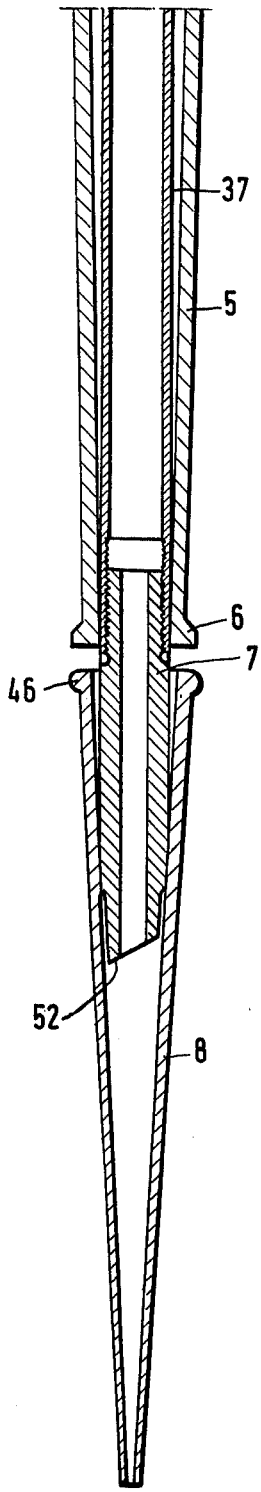
FIG. 5 is a sectional view of the portion V of the pipette device shown in FIG. 1.

As may be seen in FIG. 5, an acute edge tip 52 has been provided at the lower end of the connector or adapter cone 7. This acute edge tip may be formed by an oblique end surface of the adapter cone and serves to cut into any eventually encountered bubble-shaped skins when drawing a fluid into the pipette tip member, in order to avoid impurities from entering the inner cavity of the pipette device.

Referring to FIG. 3, the various stops 20 to 23 and the mechanical detent 94 allow to select various predetermined pipetting volumes by rotating the actuating button 10. In the detent, the flange 13 includes at least one radial portion extending through radial recesses of a downwardly facing rim 53 integral with the casing. When being moved downwardly through a distance 13*a,* this portion may be rotated and then fitted into different recesses of the rim 53. With reference to FIG. 6 these recesses are shaped so that stops 20 to 23 may be moved into a predetermined alignment with respect to the abutment 25. The sleeve 24 is indicated by this reference numeral in FIG. 6. The cylindrical wall in FIG. 6 includes at its left hand side an extension 54 movable along an axial groove 55 of an inwardly projecting casing guide 56 for securing the abutment 25 against rotary movements. As may be seen from FIG. 6, the stops are arranged in pairs, and this may best be seen by inspecting stops 22, 23.

The stop 20' is associated with the stop 20, and the stop 21' is associated with the stop 21. In the position shown in the drawing, radial recesses 57, 58, 59, 60 are associated with the stops 22, 23 and 21, 21' respectively. The stops may pass through the respective recesses. Merely the recesses 20, 20' do not encounter recesses so that these stops will entrain the abutment 25 downwardly and thereby disengage the detent 18. When rotating the actuating button 10 by 120° clockwise, then the stops 22, 23 would be effective against the abutment disc. As will be apparent from the above description, the height of the stroke may be selected in accordance with a calibrated pipetting volume.

Figure 7:
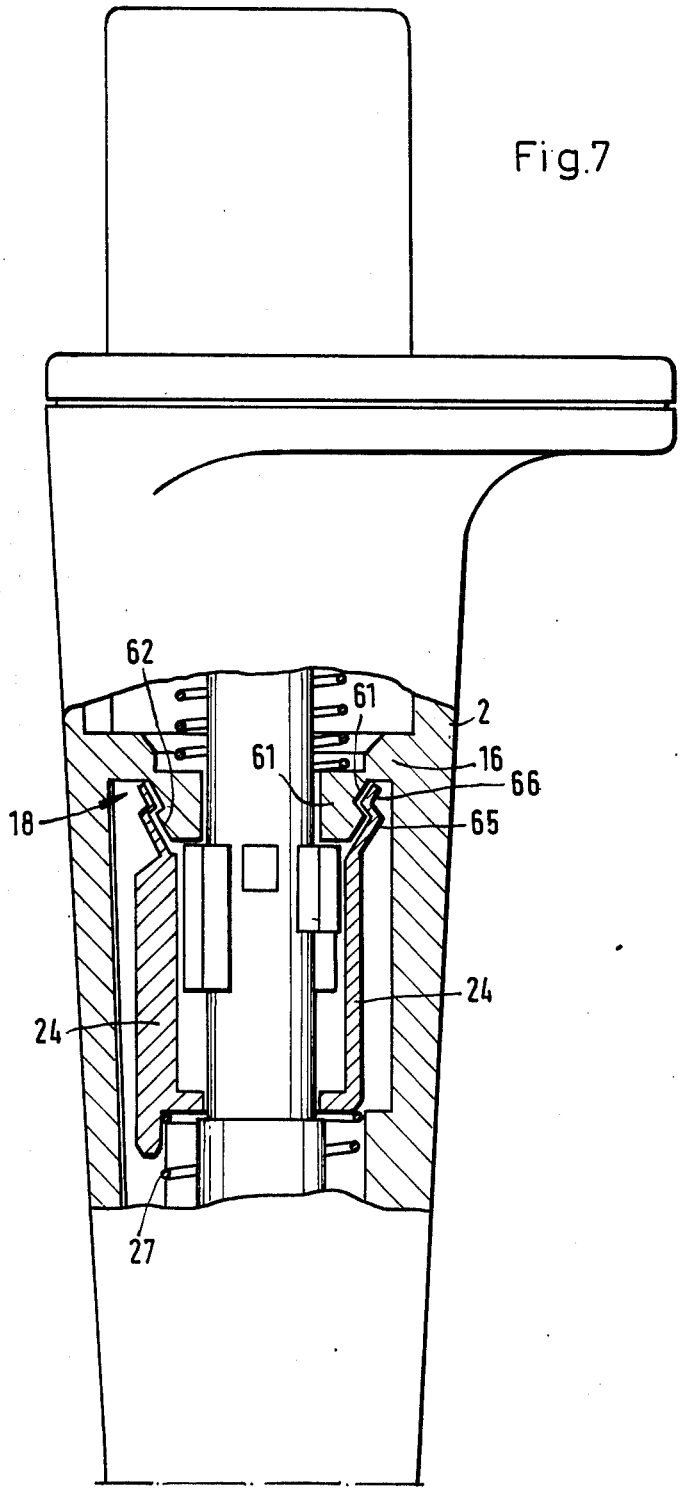
FIG. 7 is a sectional view corresponding to FIG. 3 but showing another embodiment.

Referring to FIG. 7, parts that are similar to parts in FIG. 3 are designated by the same reference numerals. The detent 18 indicated generally by the reference numeral 18 includes a member 61 that is rigidly mounted at the shoulder 16 of the casing portion 2. This member 61 includes a downwardly tapering conical engagement surface 62 with a peripheral detention groove 63. Resilient detent fingers 65 integral with the movable sleeve 24 may engage, by curved or bent detent portions 66, the peripheral detention groove 63. It will be apparent that the resilient detent fingers 65 will become disengaged from the detention groove 63 when the sleeve 24 moves downwardly, and will be guided along the conical engagement surface 62 when the sleeve 24 is being moved upwardly by the spring 27 until the fingers 65 engage the detention groove 63. This mechanical detent is likewise usable although a magnetic detent is being preferred. The embodiment shown in FIG. 7 exhibits the characteristic that the retaining force will cease upon disengagement whereby initially and additionally the downward movement is being facilitated.

Figure 8:
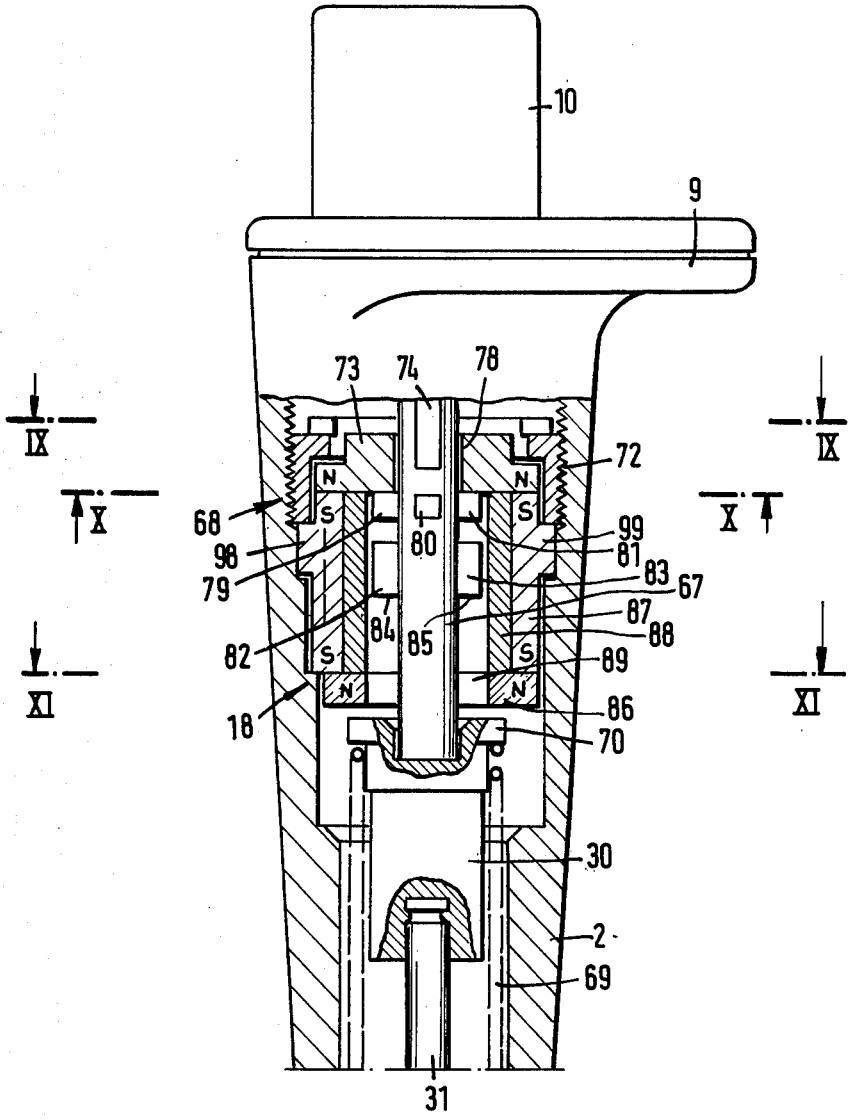
FIG. 8 is a longitudinal fragmentary sectional view of part of portion III of still another embodiment of the pipette device of the present invention.
Figure 9:
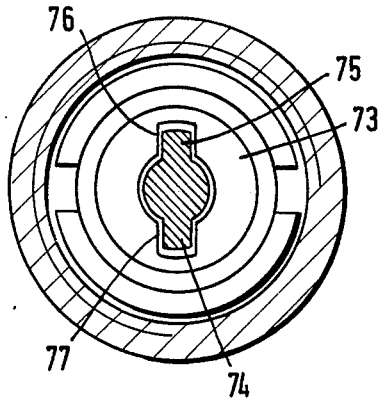
FIG. 9 is a cross sectional view along the line IX—IX of FIG. 8.
Figure 10:
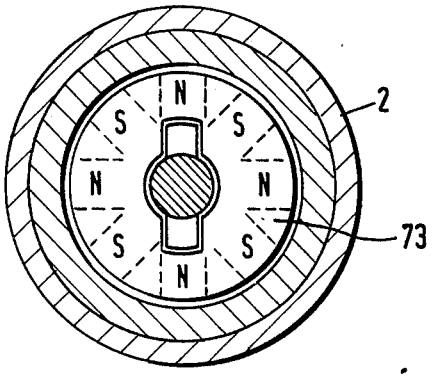
FIG. 10 is a cross sectional view along the line X—X of FIG. 8.

In the embodiment shown in FIGS. 8 to 10 the actuating button 10 is non-rotatably connected to a piston rod 67, the stop member 30 is connected to the lower end of the piston rod 67, and the piston 31 is rigidly mounted within the stop member 30.

Figure 11:
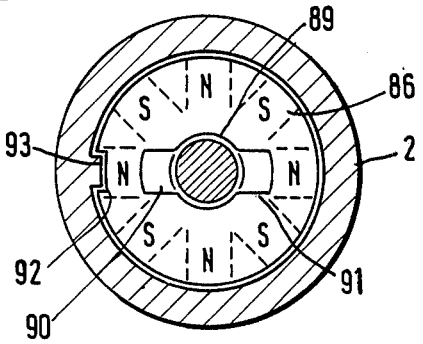
FIG. 11 is a sectional view along the line XI—XI of FIG. 8.

In this further embodiment a pair of magnetic assemblies are associated with the piston rod 67. One of these magnetic assemblies consists of the releasable detent 18 already described above whereas the other magnetic assembly 68 serves for rotational adjustment. In this context reference is being made also to FIGS. 9 to 11. When comparing this embodiment to the embodiment of FIG. 3, it may be seen that the spring 12 has been omitted because the spring 69 being urged by its upper end against a flange 70 of the stop member 30 also performs the function of retaining the actuating button 10 in its uppermost position. In this embodiment a mounting element 72 is threadedly mounted in the casing portion 2, and this mounting element 72 serves to rotatably mount a member 73 of the magnetic assembly 68, and to non-rotatably mount the other member 87. The piston rod 67 passes through a center bore 78 of the member 73. The piston rod 67 includes lands 74, 75 projecting into radial grooves 67, 77 of the disc-shaped member 73 for providing a non-rotary connection allowing for axial movement between piston rod and disc-shaped member. Below the disc-shaped member 73 the piston rod 67 may include e.g. four stops 79 to 81 for preventing an upward movement of the piston rod through the disc-shaped magnetic member 73. Additional stops 82, 83 are disposed axially below the stops 79 and 81 and associated therewith. In the position shown in FIG. 8 these stops 82, 83 may be passed through radial recesses 90, 91 extending from a central aperture 89 in the magnetic disc 86 so that the bottom surfaces of the stops 80 may engage the magnetic disc 86 to disengage the releasable detent 18. This allows a further downward movement of the piston rod 67 until the bottom surface of the stop member 30 engages a member not shown in FIG. 8 but corresponding to the above described abutment disc 44. By this member the casing sleeve 5 may be displaced downwardly to achieve an ejecting action.

When rotating the actuating button 10 through 90° the bottom surfaces 84, 85 of the stops 82, 83 respectively engage the magnetic abutment disc 86 in thus defining a smaller pipetting volume.

The abutment disc 86 is made of a magnetic material and constitutes a magnetic disc that will be attracted by the magnetic attraction of the cylindrical magnetic member 87 that is secured to the inner wall of the casing. The magnetic abutment disc 86 is slidably guided within the cylindrical magnetic member 87 by means of an integral sleeve 88.

The lands 74, 75 allow to rotate the magnetic disc 73 when rotating the actuating button. In correspondence with the alternate polarities about the circumference of the magnetic disc 73 a predetermined rotational position of the magnetic disc with respect to the magnetic cylinder 87 may be obtained since the latter exhibits corresponding alternate polarities about its circumference. This unique arrangement allows for a "jogging" type of adjustment. Even if the magnetic attracting forces should be insufficient to effect precise circumferential alignments, it is possible to provide radial teeth assemblies aligned with the alternate opposite polarities. The teeth may be provided with inclined flanks or have a sinosoidal contour so that upon coarse adjustment by the gear tooth system the magnetic attraction forces ensure a precise circumferential alignment.

FIG. 8 illustrates an embodiment with two magnetic assemblies. In this context it should be pointed out that the disc 86 includes at a point of its circumference an outer groove 92 by which the disc is guided along an axial projection 93 of the casing portion 2. This engagement prevents rotational movements, and this is essential in contrast to the rotational arrangement of the piston rod 67, in order to retain the piston rod and the actuating button in a selected rotational position corresponding to a selected desired pipetting volume.

An advantage of the embodiment shown in FIG. 8 is that when moving the piston through a stroke that corresponds to the calibrated pipetting volume merely the spring 69 is being compressed. Subsequently, the detent 18 is disengaged, by a force corresponding to the pulse peak 50 shown in FIG. 12. Upon further downward movement of the actuating member, the portion of the characteristic indicated by 12' in FIG. 12 virtually represents an extension of the portion 12 which implies that the force required for blowing out air does not increase at a higher rate than the force required during the first portion 12. When reaching the last portion, the spring 39 must be compressed (see FIG. 4).

When only a single magnetic assembly is provided as described above, there would e.g., be used the magnetic assembly 68 the members of which are provided with profiled portions extending in circumferential direction as shown in FIGS. 9 and 10. The enlargements 98, 99 along the magnetic cylinder or respectively the cylindrical member 87 would be axially directed bar-type projections movable upwardly and downwardly along axial grooves in the casing in thus guiding the member 87 for axial translatory movements whereby the member 87 is prevented from rotating with respect to the casing. With the member 87 would then be associated a non-magnetic inwardly facing flange 86 serving as an abutment disc. The magnetic disc 73 adapted to be rotated jointly with the piston rod may then be provided at its upper face with radially projecting profiled portions that may be engaged by an additional detent spring for defining the selected rotational position of the piston rod or of the actuating button 10 respectively during a stroke movement.

The embodiments of the invention in which an exclusive privilege is claimed are defined as follows:

1. In a pipette device including an elongate casing, an actuating member projecting from an upper end of said casing, spring means disposed within an internal cavity of said casing between inner casing support means and said actuating member for urging said actuating member into an outwardly projecting position, abutment means within said casing cavity between said actuating member and an inner casing wall portion for restricting movements of the actuating member outwardly from said casing, a cylinder disposed within said casing cavity, a piston slidably mounted within said cylinder and coupled to said actuating member, the piston adapted to displace an air volume, a connector extension on said casing serving as connecting means for slip-on pipette tip members open at their upper and lower ends, said connector extension having an inner through bore in communication with said cylinder, whereby said actuating member is adapted to be moved inwardly into said casing for displacing an air volume in a blow-out direction, and said actuating means is adapted to be displaced further in the same direction for performing an excess lift movement to expel a fluid volume that has previously been drawn in by movement of the actuating means in the opposite direction, the fluid volume corresponding to the air volume displaced, and to optionally move an ejector device in the axial direction of the casing, the ejector device comprising a push member slidably movable within said casing and adapted to engage the upper end edge of a mounted slip-on pipette tip member, one of the means consisting of piston, piston rod and actuating member including stop means effective as an abutment during the lifting movement of the actuating member, the improvement wherein said abutment means (24, 25, 86) is coupled to releasable detent means (18) including two members, one of said two members defining the abutment (25), and the other of said two members (26) being secured within said casing whereby said releasable detent means (18) is adapted to be released by application of a temporarily increased actuating pressure to said actuating member (10).

2. In a pipette device including an elongate casing, an actuating member projecting from an upper end of said casing, spring means disposed within an internal cavity of said casing between inner casing support means and said actuating member for urging said actuating member into an outwardly projecting position, abutment means within said casing cavity between said actuating member and an inner casing wall portion for restricting movements of the actuating member outwardly from said casing, a cylinder disposed within said casing cavity, a piston slidably mounted within said cylinder and coupled to said actuating member, the piston adapted to displace an air volume, a connector extension on said casing serving as connecting means for slip-on pipette tip members open at their upper and lower ends, said connector extension having an inner through bore in communication with said cylinder, whereby said actuating member is adapted to be moved inwardly into said casing for displacing an air volume in a blow-out direction, and said actuating means is adapted to be displaced further in the same direction for performing an excess lift movement to expel a fluid volume that has previously been drawn in by movement of the actuating means in the opposite direction, the fluid volume corresponding to the air volume displaced, an ejector device consisting of a casing sleeve movable along a portion of the casing, enveloping substantially said cylinder and being resiliently biased toward the upper end of said casing by spring means (39) interposed between an abutment secured to said casing and said casing sleeve, the improvement wherein the single actuating member consists of an actuating button (10) that is guided within said casing for axial non-rotating movements and adapted to perform the pipetting operation as well as to eject a slip-on pipette tip member (8).

3. A pipette device according to claim 1 wherein an ejector device consists of a casing sleeve movable along a portion of the casing and substantially circumscribes said cylinder and is resiliently biased toward the upper end of said casing by spring means (39) interposed between an abutment secured to said casing and said casing sleeve, and additional spring means, the spring means (12, 69) being adapted to be compressed when moving said actuating member in the form of an actuating button (10) inwardly into the casing, the spring tension along the path of spring compression increasing correspondingly, the releasable detent means (18) being releasable within this path of spring movement and defining two distinct path sections of different noticeable spring characteristics, an additional spring (39) within the casing biasing said casing sleeve (5) toward the upper end of said casing, and an increased counter pressure adapted to be generated at the end of said second path section when releasing the releasable detent means (18) by shifting said casing sleeve (5) against said additional spring means (39).

4. A pipette device according to claim 3, wherein an additional spring (27) disposed within said casing biases, by its one end, a member (24) movable along said piston rod (11) and constituting the releasable member of said releasable detent means (18), said additional spring (27) engaging, by its opposite end, a shoulder (29) within said casing and tends to engage said releasable detent means, a substantially similar actuating pressure increase being required for blowout operation upon application of a temporarily increased actuating pressure for releasing said releasable detent means (18), said additional spring being compressible along a short distance beyond the pipetting volume by movement of said piston (31), said further spring means (39) for resiliently supporting said casing sleeve (5) adapted to urge said casing sleeve (5) against said casing (2–4), and said piston rod (11) bearing a stop member (30) adapted to act on said casing sleeve (5) supported by said further spring means (39) upon release of said releasable detent means (18).

5. A pipette device according to claim 1, wherein said releasable detent means (18) consists of a releasable magnetic assembly of a pair of magnetic members, one of said magnetic members (19, 26, 87) being secured to said casing, and the other of said magnetic members (24, 86) being secured to said abutment means (25) and forming part thereof.

6. A pipette device according to claim 1, wherein said releasable detent means (18) consists of mechanical detent means (62, 63, 65, 66) for delimiting a pipetting volume, the locking force of said detent means adapted to be overcome by a temporary pressure increase, said detent means including a member (61) rigidly mounted within said casing, said member having a groove (63), and resilient detent fingers (65) arranged at said movable abutment member (24), said detent fingers having curved or bent detent portions (66) adapted to engage said groove (63), said fixed member having a conical engagement surface (62) facing said movable abutment member and extending up to the edge of said groove (63).

7. A pipette device according to claim 1, wherein said actuating button (10) and said piston rod are jointly rotatably mounted within said casing, peripherically active detent means (68, 94) is provided between said casing and said assembly of actuating button (10) and piston rod to adjust various stops (20–23; 79–83) along the piston rod (11, 67) to cooperate with said abutment means (25, 86), the piston rod (11) including a plurality of peripherically spaced stops (20–23; 79–83) extending up to different axial heights, and an abutment means (25, 86) at the releasable detent means (18) having a plurality of radial recesses (57–60; 90, 91) corresponding to the arrangement of said stops (20–23; 79–83) and adapted to pass all stops but one through the plane of said abutment disc.

8. A pipette device according to claim 5, wherein said magnetic members of said releasable detent means (18) are of alternate polarities in circumferential direction, mutual rotational displacements of said members serving to predetermine positions corresponding to a selected pipetting volume, one of said magnetic members being rotatably mounted in the casing together with the piston rod and serves as an additional detent means for releasably fixing a rotational position of said actuating button, and the other of said magnetic members being slidably but non-rotatably mounted within the casing.

9. A pipette device according to claim 1, wherein said actuating button (10) and said piston rod are jointly rotatably mounted in said casing, detent means (68, 94) operable in circumferential direction is provided between said casing and said assembly of actuating button (10) and piston rod, said detent means adapted to adjust various stops (20–23; 79–83) along the piston rod (11, 67) to cooperate with said abutment means (25, 86), an additional magnetic assembly (68) comprising cooperating disc-shaped or respectively annular magnetic members (73, 87) having alternate polarities in circumferential direction and being adapted to be rotated into various mutual rotational positions corresponding to preselected pipetting volumes, said disc-shaped magnetic member (73) engaging the piston rod (67) whereby the piston rod may be moved axially but not rotated with respect to the magnetic member, and the other of the magnetic members (87) being rigidly secured to said casing.

10. A pipette device according to claim 1, wherein said actuating button (10) and said piston rod are jointly rotatably mounted in said casing, detent means (68, 94) operable in circumferential direction is provided between said casing and said assembly of actuating button (10) and piston rod, said detent means adapted to adjust various stops (20–23; 79–83) along the piston rod (11, 67) to cooperate with said abutment means (25, 86), an additional magnetic assembly (68) comprising cooperating disc-shaped or respectively annular magnetic members (73, 87) having alternate polarities in circumferential direction and being adapted to be rotated into various mutual rotational positions corresponding to preselected pipetting volumes, said cooperating disc-shaped or respectively annular magnetic members (73, 87) including circumferential radial profile projections with inclined flanks or of a sinosoidal configuration adapted to ensure a precise circumferential alignment by the magnetic attraction.

11. A pipette device according to any of the preceding claims 9–10, wherein a gap is provided between the mutually opposed faces of the disc-shaped magnetic members, and in this gap is disposed at least one thin layer of e.g., a low-friction plastic material or a skidding lacquer.

* * * * *